US007325819B2

(12) United States Patent
Kwak

(10) Patent No.: US 7,325,819 B2
(45) Date of Patent: Feb. 5, 2008

(54) SKATEBOARD

(76) Inventor: No Un Kwak, 301 N. Beauregard St., Apartment # 1616, Alexandria, VA (US) 22312

( * ) Notice: Subject to any disclaimer, the term of this patent is extended or adjusted under 35 U.S.C. 154(b) by 262 days.

(21) Appl. No.: 11/041,729

(22) Filed: Jan. 25, 2005

(65) Prior Publication Data

US 2006/0163830 A1 Jul. 27, 2006

(51) Int. Cl.
*A63C 17/01* (2006.01)

(52) U.S. Cl. ..... 280/87.042; 280/87.05

(58) Field of Classification Search ..... 280/87.042, 280/87.05

See application file for complete search history.

(56) References Cited

U.S. PATENT DOCUMENTS 4,076,267 A * 2/1978 Lipscomb ..... 280/87.042
4,082,306 A * 4/1978 Sheldon ..... 280/87.042
4,930,924 A * 6/1990 Hunt ..... 403/24
4,955,626 A * 9/1990 Smith et al. ..... 280/87.042
5,458,351 A * 10/1995 Yu ..... 280/87.042
5,505,474 A * 4/1996 Yeh ..... 280/87.042
5,613,695 A * 3/1997 Yu ..... 280/14.25
7,083,178 B2 * 8/2006 Potter ..... 280/87.042
2002/0149166 A1 * 10/2002 Potter ..... 280/87.042
2004/0262872 A1 * 12/2004 Kang ..... 280/87.042
2006/0055137 A1 * 3/2006 Jiang ..... 280/87.042

* cited by examiner

*Primary Examiner*—Jeff Restifo
(74) *Attorney, Agent, or Firm*—Steven Kreiss

(57) ABSTRACT

A skateboard apparatus wherein a torsion bar containing an inner pipe, outer pipes and flexible, rubber inserts therebetween assist the user in determining the direction and speed of the skateboard. The torsion bar is connected to platforms on which the user places his feet, and the underside of said platforms contain casters which enable the skateboard and its user to move in linear or non-linear directions as desired with just one initial push from the ground.

10 Claims, 8 Drawing Sheets

Fig. 2A
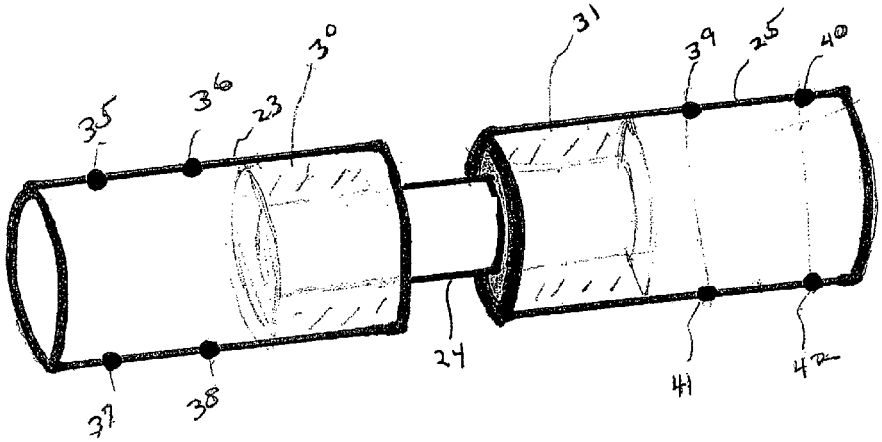
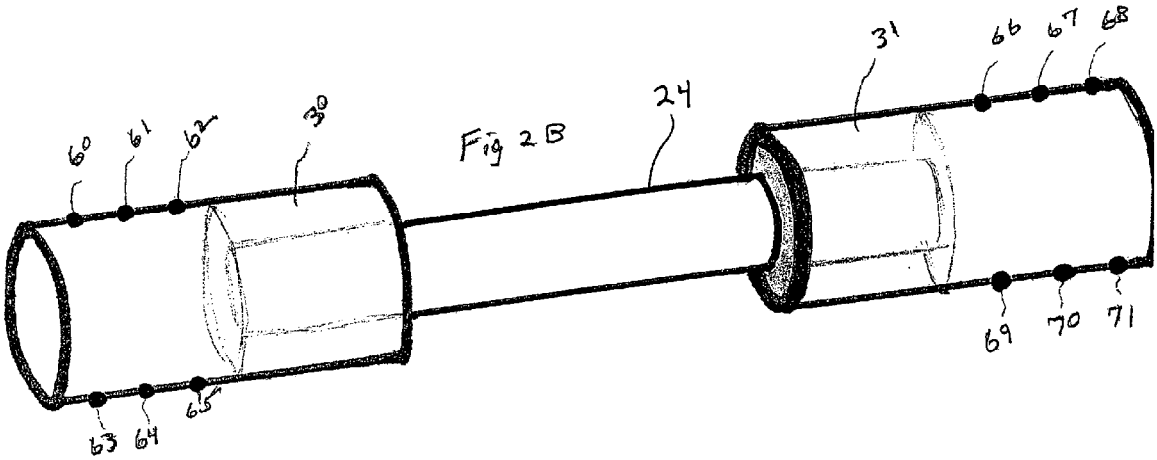
Fig 2B

SKATEBOARD

BACKGROUND OF THE INVENTION

The Skate Board invention relates to skateboards for carrying persons from one destination to another through use of said boards. Skateboards and their use have been well known in the prior art. A skateboard may have a single integral platform onto which the user may step or the platform may be divided into two separate but connected platforms, with each foot, or one of them, resting upon a separate platform. In the case of either the single platform or two-part platforms, wheels are mounted on the underside of said platform or platforms in order to propel the user forward by a push or pushes on the ground from the user.

If the skateboard wheels are fixed and rotate in only one direction, then in order for the user to turn the skateboard, he will be required to raise the front end of the skateboard to swivel and turn direction. In some skateboards, casters are used as wheels, and these casters can rotate in different directions and thus change the direction of the skateboard without having to raise the front end of the skateboard. Pressure from the user's legs provides the required torque to propel and turn the skateboard after an initial push. Regardless of whether the single or double platform configuration is used with either wheel configurations noted above, these prior art skateboards require their users to constantly push on the ground with their feet to obtain power and movement. In contrast, the present skateboard invention permits users to simply use their body movements to obtain power and movement, after an initial push, without having to continuously push themselves with their feet touching the ground.

SUMMARY OF THE INVENTION

This skateboard invention relates to skateboards wherein all its components are made of durable materials. Different materials may be used to make the skateboard depending upon a user's choice. For example, the skateboard user may desire a lightweight skateboard to be made substantially of polyurethane. Another skateboard user may desire that his skateboard be heavier and thus substantially made from wood. The invention is easily manufactured from different materials depending upon the user's preference. The inventive skateboard or the like has two separate platforms, one for each foot, and each platform is configured in such a way for easy mounting and thrust from an initial push on the ground by the user. Once the initial thrust is made by the user, the user may propel the skateboard without removing his feet from the skateboard. A substantial swivel or sinusoidal motion from the user can propel the user forward on the skateboard. A user's motion of twisting the body can create turns or movements of the skateboard in nonlinear or linear directions as desired by the user. Such nonlinear movement is facilitated by two or more casters affixed into, or to the underside of, the platforms. The user may turn around on the inventive skateboard without having to dismount therefrom. The momentum from the user's initial thrust from the ground, as well as his subsequent body movement, provides the necessary energy to maintain the skateboard's movement.

In order to facilitate the turning or nonlinear motion of the inventive skateboard, two outer pipes and one inner pipe, with flexible, rubber inserts forming a connection between the outer pipes and inner pipe, are used in conjunction with two platforms to form a substantial part of the skateboard. These pipes and rubber inserts form a torsion bar, which is used to connect the two platforms together. Of these three pipes, the inner pipe either does not rotate or turn or experiences insubstantial rotation. It is attached and anchored at both ends to the flexible, rubber inserts. Of the three pipes, the two outer pipes are capable of rotating or turning, in combination or separately, in the same direction and to a proportional extent as their respective platforms. The rubber inserts are anchored to the outside edge of the ends of the inner pipe and the inside edge of one end of each of the outer pipes. These rubber inserts are capable of rotating or turning in the same direction and proportionately to the same extent as the two outer pipes. The above referenced torsion bar configuration provides stability, strength and motion to the skateboard. No other skateboard prior to the inventive one described herein contains all the features necessary for the stable linear and nonlinear motion described above.

In summary, the salient features of the inventive skateboard are: (a) two separate platforms enabling the user to mount the skateboard with two feet if desired, (b) a torsion bar made from a plurality of pipes and rubber inserts enabling the user to propel the skateboard forward or elsewhere through use of the user's twisting or sinusoidal motion and to turn the skateboard at the user's command in a safe, stable and simple manner as a result of the rotating or turning capability of designated pipes and the rubber inserts of the torsion bar, and (c) casters functioning in tandem with the torsion bar to propel the skateboard in a desired direction at the user's command through use of said user's twisting or sinusoidal motion.

BRIEF DESCRIPTION OF THE DRAWINGS

FIG. 2A is a side elevation view of the torsion bar component of the invention.

FIGS. 2B-2D are other side elevation views of the torsion bar component of the invention.

FIG. 6 is a front or rear cross sectional view of the invention.

DESCRIPTION OF THE DRAWINGS

Figure 1:
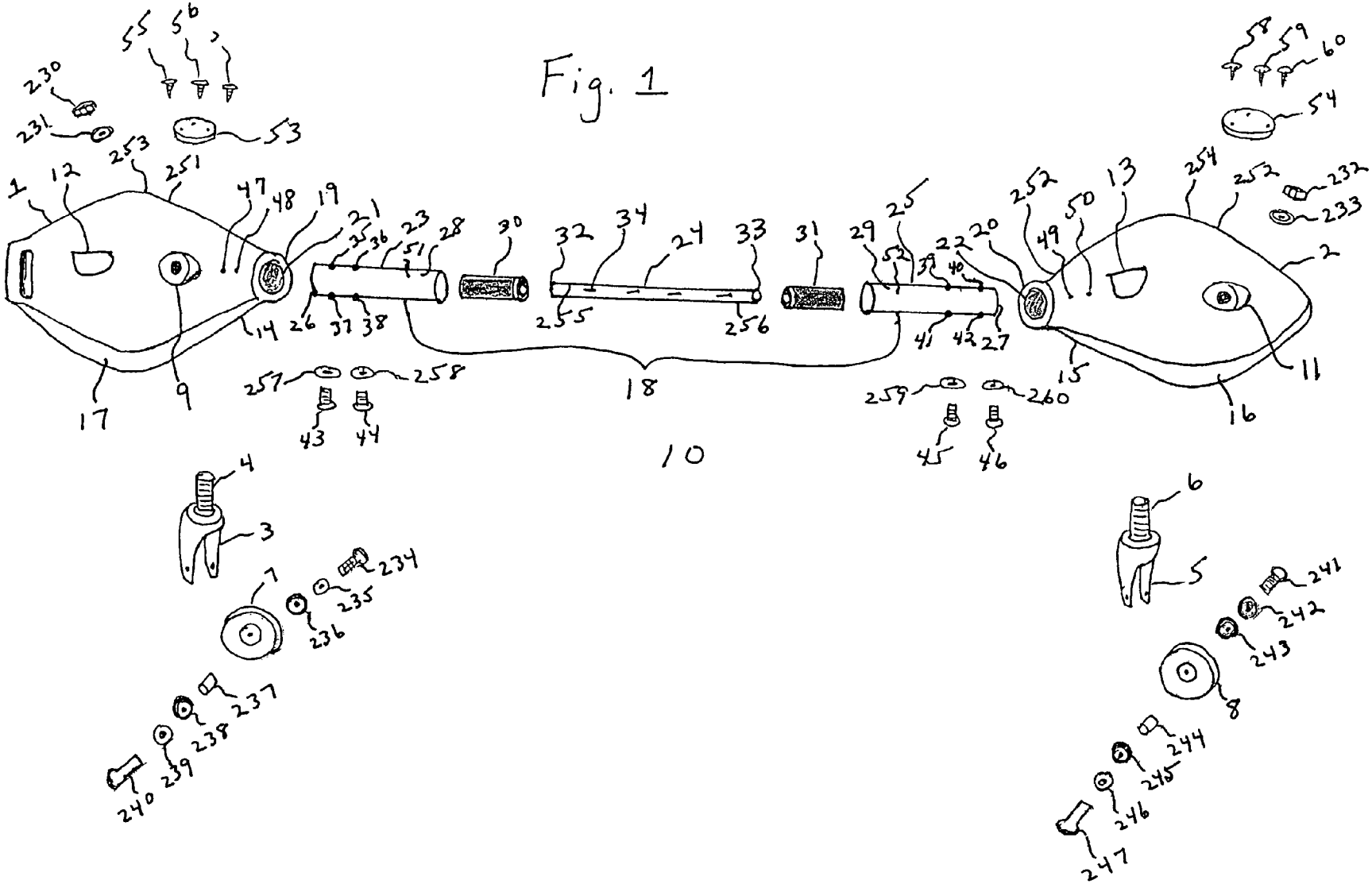
FIG. 1 is an elevation view of the invention.

The skateboard 10 shown in FIG. 1 contains a rear platform 1 for a user's foot and a front platform 2 for the user's other foot. A holder bracket 3 with connecting screw 4 is attached to the underside of the rear platform 1 and is held in place with nut 230 and washer 231. A similar holder bracket 5 with connecting screw 6 is attached to the underside of the front platform 2 and is held in place with nut 232 and washer 233. Caster 7 is connected to bracket 3 by bolt 234, bushing 235, bearing 236, liner 237, bearing 238, bushing 239, shaft 240, and caster 7 functions to roll across the ground much like the rollers on a roller-skate. Similarly, caster 8 is connected to bracket 5 by bolt 241, bushing 242, bearing 243, liner 244, bearing 245, bushing 246, shaft 247, and caster 8 also functions to roll across the ground much like the rollers on a roller-skate. The casters 7,8 may roll in a linear or nonlinear direction depending upon the user's desire. The casters 7,8 may rotate 360 or fewer degrees if the user so chooses in order to turn the skateboard 10 partially or totally around. Platforms 1,2 contain holes 9,11 into which holder bracket screws 4,6 fit, thereby securing the casters 7,8 to platforms 1,2. The holes 9,11 have covers 53,54 respectively which are secured to the platforms 1,2 by screws 55-57 and 58-60 respectively.

Each platform 1,2 may have an area 12,13 specifically marked for the placement of each foot, and each such area 12,13 may be constructed in such a way that the user's feet do not slide in inclement weather or if the ground upon which the skateboard 10 is traveling is slippery or wet. Although the preferable shape of the skateboard 10 platforms 1,2 is substantially elliptical, the platforms 1,2 may be constructed in other shapes and may even be combined in one platform. Furthermore, the sides 14,15 of the platforms 1,2 may be contoured so that portions 16,17 of said sides 14,15 are thicker and may be used as brakes for the purpose of decelerating or stopping the motion of the skateboard 10. Similarly, the corresponding sides 251,252 of platforms 1,2 may also be contoured so that portions 253,254 of said sides 251,252 are thicker and also may be used as brakes for the purpose of decelerating or stopping the motion of the skateboard 10.

A torsion bar 18 is attached to one end 19,20 of each platform 1,2 and fits snugly into an opening 21,22 in each platform 1,2. The torsion bar 18 contains three pipes 23,24, 25 and two flexible, rubber inserts 30,31. Of the three pipes 23-25, two are outer pipes 23,25 and the third is an inner pipe 24. The two outer pipes 23,25 have outer sides 26,27 and fit snugly within platform holes 21,22. The inner sides 28,29 of outer pipes 23,25 are secured to the rubber inserts 30,31 through a glue-like substance. One end 32 of the inner pipe 24 is secured within rubber insert 30 while the other end 33 is secured within rubber insert 31. While the outer pipes 23,25 are able to rotate proportionally with respect to their respective platforms 1,2, even though they snugly fit within openings 21,22 of these platforms, the inner pipe 24 does not rotate or rotates insubstantially. The inner pipe 24 may have the same centerline 34 as the outer pipes 23,25. Each outer pipe 23,25 contains four screw holes 35-38, 39-42 which are used to attach the torsion bar 18 to each platform 1,2 through use of screws 43-46 and screw holes 47-50. In this manner, as each platform 1,2 rotates at the user's motion, the outer pipes 23,25 associated with platforms 1,2 rotate. Screws 43,44 and washers 257,258 connect the torsion bar 18 to the underside of the rear platform 2 through holes 47,48 respectively while screws 45,46 and washers 259,260 connect the torsion bar 18 to the underside of the front platform 1 through holes 49,50 respectively. The platforms 1,2 may be constructed from a polyurethane material.

The flexible, rubber inserts 30,31 positioned between outer pipes 23,25 and inner pipe 24 may be constructed as follows. Sandpaper the inner surfaces 51,52 of the outer pipes 23,25 and the outer surfaces 255,256 of the inner pipe 24. Clean and dry the sanded surfaces. Apply a primer to the sanded surfaces. Allow the primer to dry and place the inner pipe 24 into the outer pipes 23,25 so that all pipes have the same centerline 34. Pour liquid rubber, such as nitrile butadiene rubber, into the space between the outer pipes 23,25 and inner pipe 24 until the space is filled with liquid rubber. The insides 51,52 of the outer pipes 23,25 must be plugged or capped in the pouring process to prevent the rubber from pouring all the way through the pipes 23,25. These liquid rubber inserts 30,31 attach the insides 51,52 of the outer pipes 23,25 to the outer sides 255,256 of the inner pipe 24. After the rubber has cured, the torsion bar 18 is formed. Other ways of incorporating the rubber inserts 30,31 between the outer pipes 23,25 and the inner pipe 24 are well known to those of ordinary skill in the art. The rubber inserts 30,31 may twist proportionately to the full extent of the rotation of either or both the outer pipes 23,25. The inner pipe, however, does not rotate or rotates insubstantially. The torsion bar 18 provides stability to the skateboard 10 and permits the user to propel or turn the skateboard 10 as the user commands.

FIG. 2A illustrates the torsion bar 18 with a shorter inner pipe 24. This embodiment is useful and optional for users having a body weight below 180 pounds. The outer pipes 23,25 are shown attached to the inner pipe 24. At the connection site, rubber inserts 30,31 are shown attaching the outer pipes 23,25 to the inner pipe 24. Four pinholes 35-38 and 39-42 are shown in the outer pipes 23,25 to attach the torsion bar 18 to the platforms 1,2 of the skateboard 10.

FIG. 2B illustrates a torsion bar 18 with a longer inner pipe 24 to accommodate optimally users with a body weight of over 180 pounds. Although four pinholes may suffice to provide the necessary attachment between the torsion bar 18 and platforms 1,2, six pinholes 60-65 and 66-71 are shown to attach the outer pipes 23,25 to the platforms 1,2 of the skateboard 10. Another screw and washer combination, not shown, in conjunction with screw and washer combinations 43,257 44,258, 45,259, 46,260 as shown in FIG. 1, will be necessary to accomplish the six pinhole attachment.

Figure 2C:
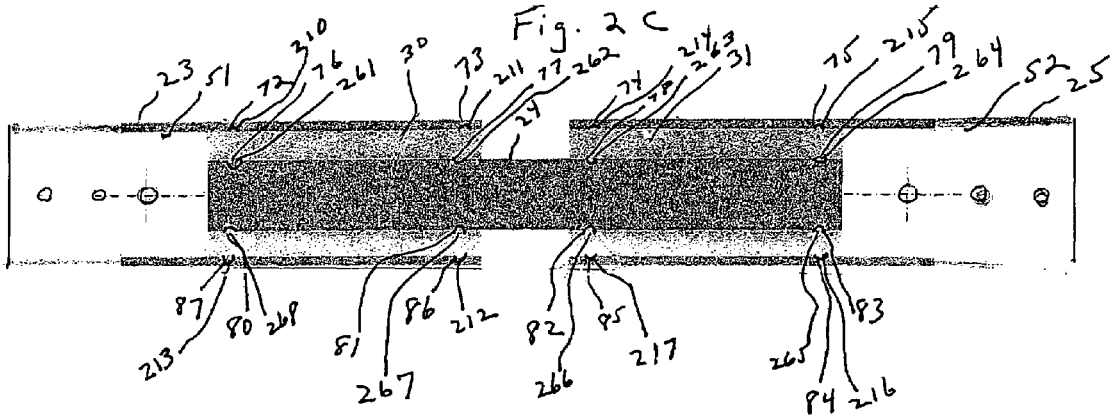

FIG. 2C illustrates a further embodiment of the torsion bar 18 whereby four grooves 72,73,86,87 and mating nubs 210,211,212,213 are contained within the inner surface 51 of outer pipe 23, and four grooves 74,75,84,85 and mating nubs 214,215,216,217 are contained within the inner surface 52 of outer pipe 25. Eight grooves 76-83 and mating nubs 261-268 are contained within inner pipe 24. These grooves 72-87 and mating nubs 210-217 and 261-268 provide (a) additional support for the position and function of and connection between outer pipes 23,25, inner pipe 24 and/or the flexible, rubber inserts 30,31 therebetween, and (b) a mechanism by which to further secure the flexible, rubber inserts 30,31 to the outer pipes 23,25 and inner pipe 24. These grooves 72-87 and mating nubs 210-217 and 261-268 also prevent or substantially prevent rotation of inner pipe 24. Friction between the outer pipes 23,25 and the rubber inserts 30,31 is increased when an uneven surface, such as nubs and grooves, is created between the two. Although eight grooves 72-75 and 84-87 and mating nubs 210-217 are shown in outer pipes 23,25 and eight grooves 76-83 and mating nubs 261-268 are shown in inner pipe 24, this skateboard invention is not limited to this number of grooves and mating nubs.

Figure 2D:
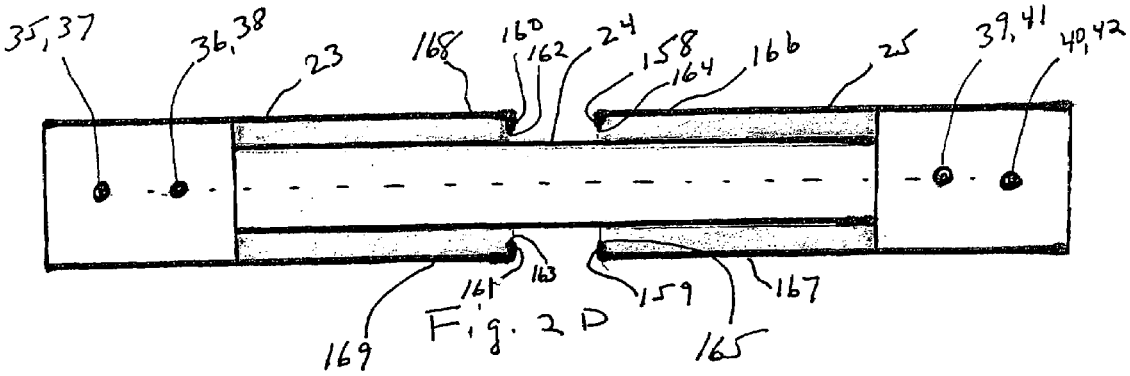

In FIG. 2D, the outer pipes 23,25 are folded inwardly to create folds 158-161 so that the diameter of the inner edges 162-165 of the outer pipes 23,25 is smaller than the diameter of the outer edges 166-169 of the outer pipes 23,25. Although FIG. 2D shows an embodiment of a four pinhole 35-38 and 39-42 connection between outer pipes 23,25 and platforms 1,2, it should be understood that a six hole 60-65 and 66-71 connection embodiment, as shown in FIG. 2A, may be used with this embodiment.

Figure 3A:
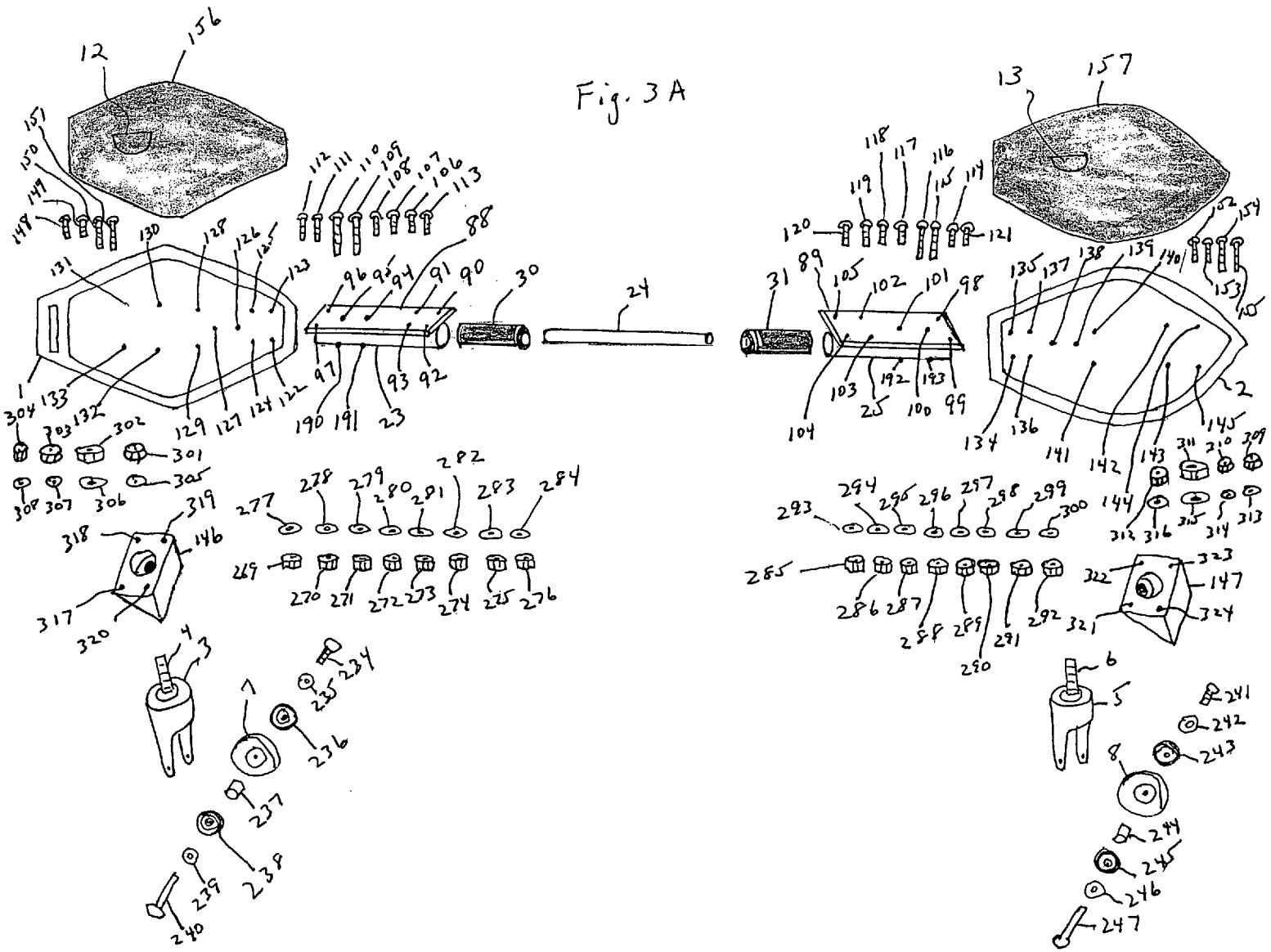
FIGS. 3A and 3B are elevation views of the invention.

FIG. 3A shows the two platforms 1,2 and torsion bar 18 in a wooden skateboard configuration. The torsion bar 18 contains three pipes 23-25. There are two outer pipes 23,25 and one inner pipe 24. The outer pipes 23,25 are connected to two respective wooden boards 88,89 through a plurality of holes 90-97, 190,191 and 98-105, 192,193, screws 106-113 and 114-121, nuts 269-276 and 285-292, and bushings 277-284 and 293-300. The boards 88,89 are also attached to the undersides of their respective platforms 1,2 through corresponding holes 122-129 and 134-141. Wooden intermediary brackets 146,147 with holes 317-320 and 321-324 respectively are used to attach the respective casters 7,8 and their respective brackets 3,5 to said respective platforms 1,2 through use of respective screws 148-151 and 152-155, holes 130-133 and 142-145, nuts 301-304 and 309-312, and washers 305-308 and 313-316. The skateboard 10 shown in FIG. 3A is made substantially from wood. The screws 106-113, 114-121, 148-151 and 152-155 are shown covered by overlapping material 156,157. Caster 7 is shown connected to bracket 3 by bolt 234, bushing 235, bearing 236, liner 237, bearing 238, bushing 239, and shaft 240, while caster 8 is shown connected to bracket 5 by bolt 241, bushing 242, bearing 243, liner 244, bearing 245, bushing 246, and shaft 247 as also shown in FIG. 1.

Figure 3B:
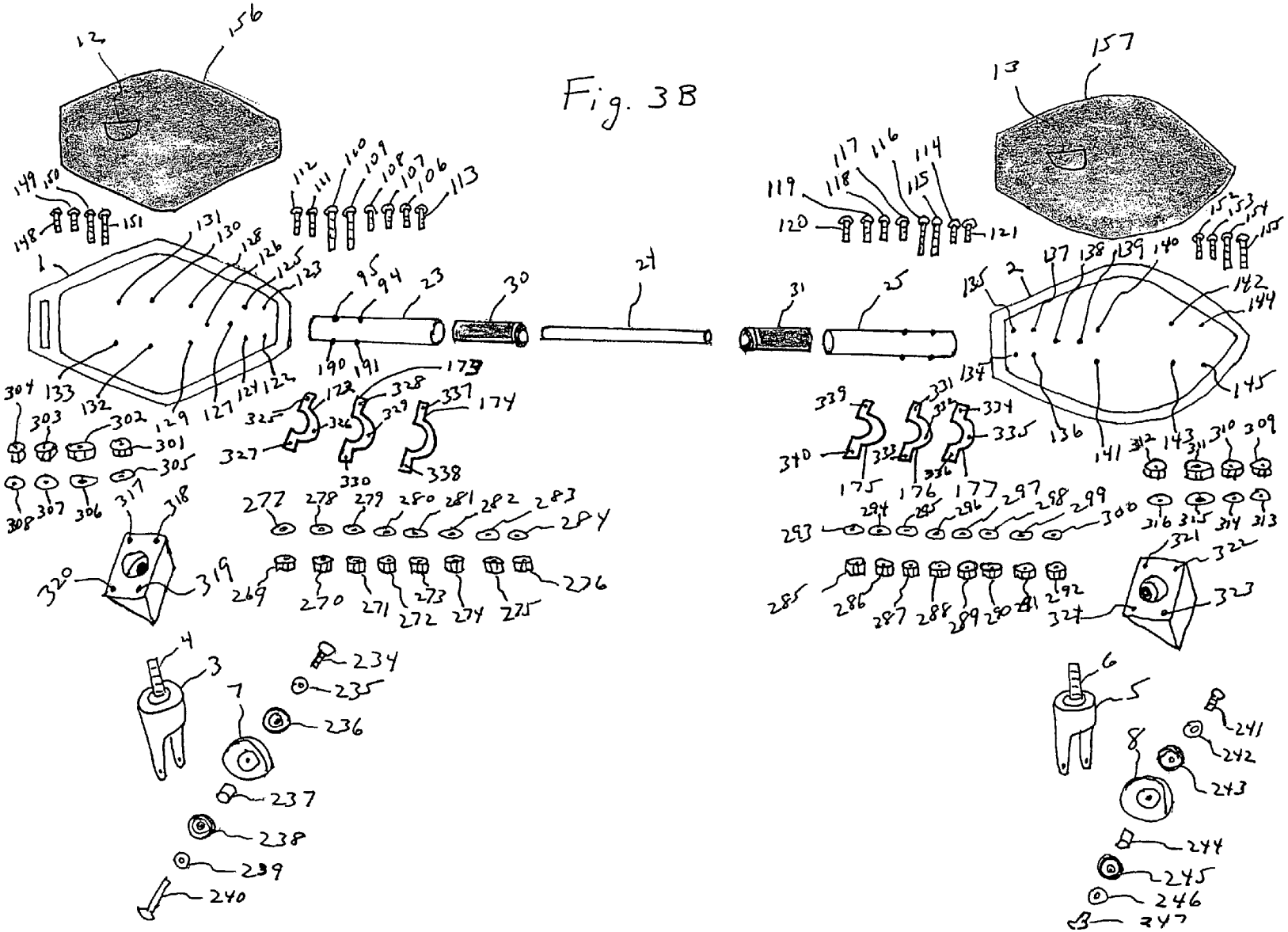

FIG. 3B likewise illustrates a wooden skateboard 10. Instead of wooden boards 88,89 providing the connection between outer pipes 23,25 and platforms 1,2, clamps 172-174 and 175-177 are used to secure the outer pipes 23,25 to said platforms 1,2 respectively. Clamps 172, 173, 176, and 177 each have three holes 325-327, 328-330, 331-333, and 334-336 respectively contained therein, while clamps 174 and 175 have two holes 337-338 and 339-340 respectively contained therein. These holes 325-330, 337-338, and 331-336, 339-340 mate with screws 106-113 and 114-121, nuts 269-276 and 285-292, washers 277-284 and 293-300 and platform holes 122-129 and 134-141.

Figure 4:
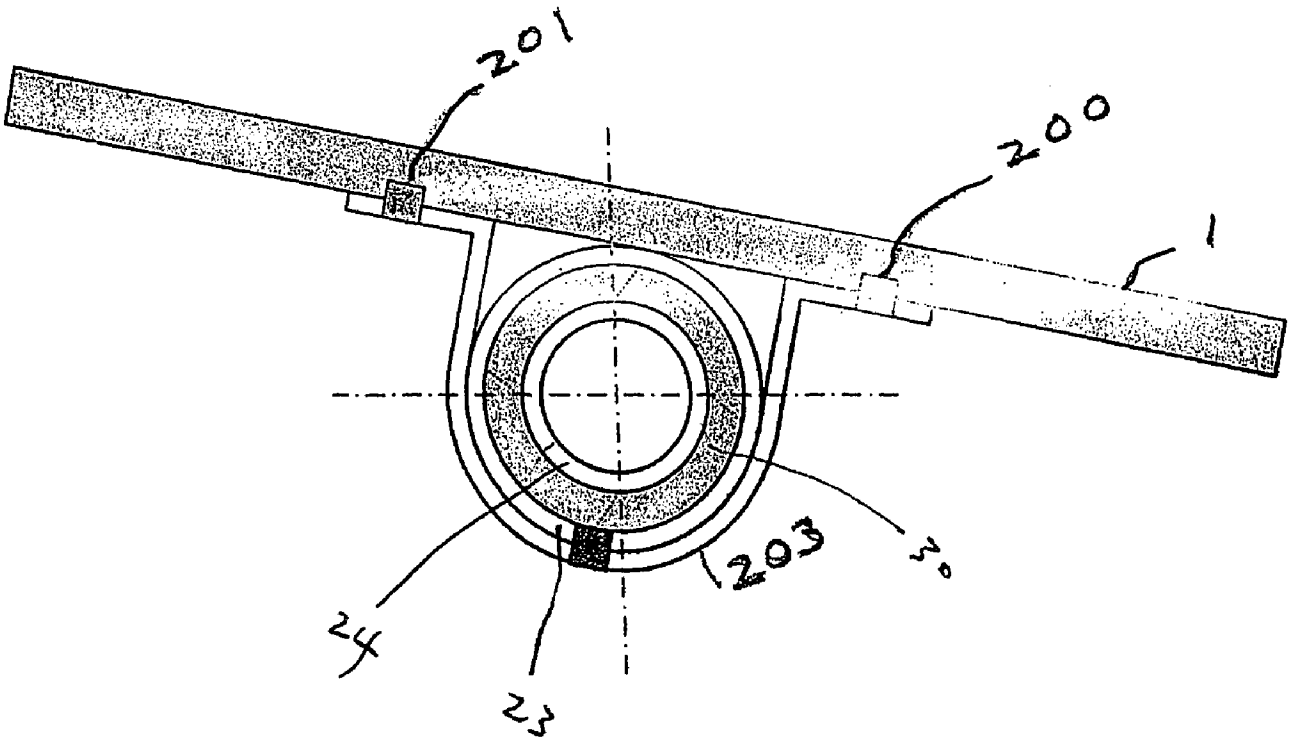
FIG. 4 is a rear cross sectional view of the invention.

FIG. 4 shows the rear platform 1 rotating in a clockwise direction. During this rotating motion, the inner pipe 24 of the torsion bar 18 is not rotating or is insubstantially rotating. The rubber insert 30 that attaches the inner pipe 24 to the outer pipe 23 remains anchored to the non-rotating or insubstantially rotating inner pipe 24. When the rear platform 1 is rotated in a clockwise direction, the outer pipe 23 proportionately rotates in the same clockwise direction as its respective platform 1. The rubber insert 30 attaching the inner pipe 24 and outer pipe 23 also twists proportionately in the same clockwise direction as the outer pipe 23. A clamp 203 is shown in FIG. 4 as containing two connections 200,201 to the underside of the rear platform 1 of the skateboard 10. A similar clamp, not shown, is used for the front platform 2 connection to the torsion bar 18.

Figure 5:
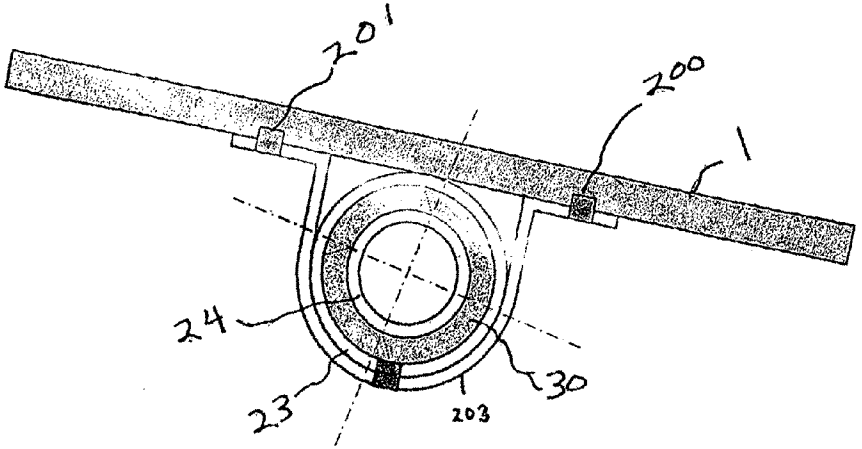
FIG. 5 is a front cross sectional view of the invention.
Figure 9:
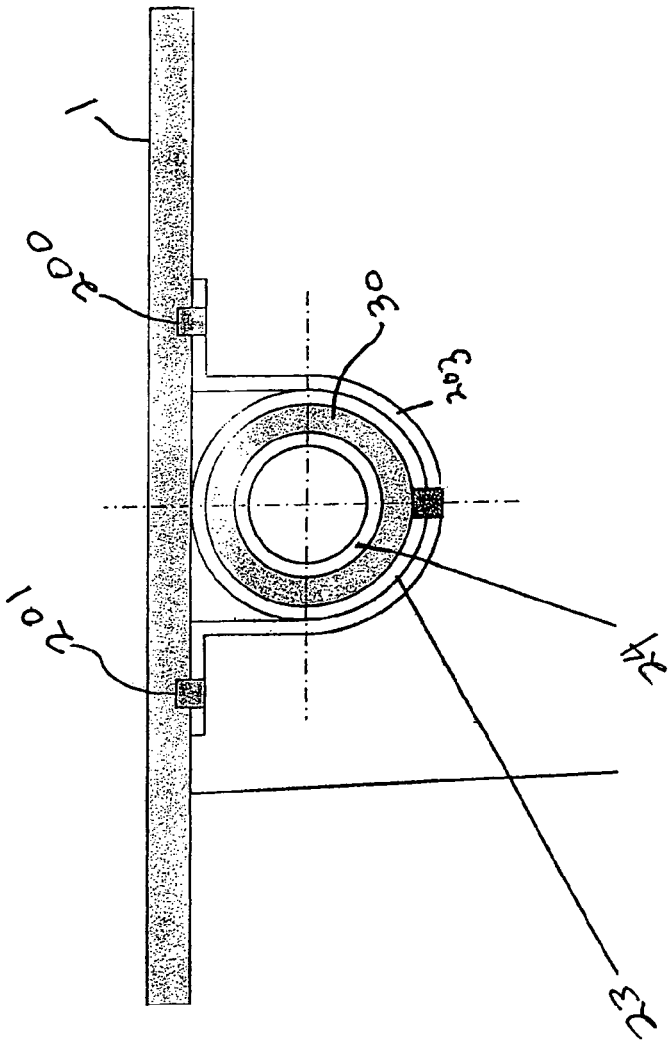

FIG. 5 shows the rear platform 1 of the skateboard 10 rotating in a counterclockwise direction. The clamp 203 described in reference to FIG. 4 is likewise shown in FIG. 5. FIG. 6 shows the clamp 203 connected to the rear platform 1 when it is proceeding in a linear direction. No rotation of the skateboard 10 is shown in FIG. 6. If a user desires to turn in a clockwise direction, then he would only need to push his left foot forward a little while pushing his right heel down on the rear platform 1. If the user wants to turn in a counterclockwise direction, then the right foot would push forward while pushing the left heel down on the front platform 2. Movement of the skateboard requires only the front and/or back motion of the user's feet on the skateboard. With this movement, a user can travel uphill, downhill or on a level road without providing the skateboard 10 with additional pushes from his feet beyond that of the initial push.

What I claim is:

1. A skateboard comprising:

(a) a front rotatable platform and a rear rotatable platform;

(b) a torsion bar means attached to the front and rear platforms, said torsion bar comprising a plurality of outer pipes capable of rotating in proportion to the rotation of either or both platforms, an inner pipe, and a plurality of flexible insert means connecting said inner pipe to said outer pipes whereby said flexible insert means twists in proportion to the rotation of said outer pipes; and (c) caster means attached to an underside of the front and rear platforms for permitting the skateboard to be placed in motion by a user.

2. The skateboard of claim 1 wherein the inner pipe contained within the torsion bar does not rotate when an outer pipe of said torsion bar rotates.

3. The skateboard of claim 1 further comprising a means within each platform into which an end of the torsion bar may fit.

4. The skateboard of claim 1 further comprising nub and groove means in said outer pipes to secure the flexible insert means to said outer pipes.

5. The skateboard of claim 1 further comprising nub and groove means in said inner pipe to secure the flexible insert means to said inner pipe.

6. The skateboard of claim 1 wherein the outer pipes further comprise a folding means to secure the flexible insert means to said outer pipes.

7. The skateboard of claim 1 further comprising a board means for attaching each outer pipe to its respective platform.

8. The skateboard of claim 1 further comprising a means to clamp each outer pipe to its respective platform.

9. The skateboard of claim 4 wherein the inner pipe of the torsion bar does not rotate.

10. The skateboard of claim 9 further comprising nub and groove means in said inner pipe to secure the flexible insert means to said inner pipe.

* * * * *